ERECTING PRECAST HORIZONTAL SLABS IN BUILDING CONSTRUCTION

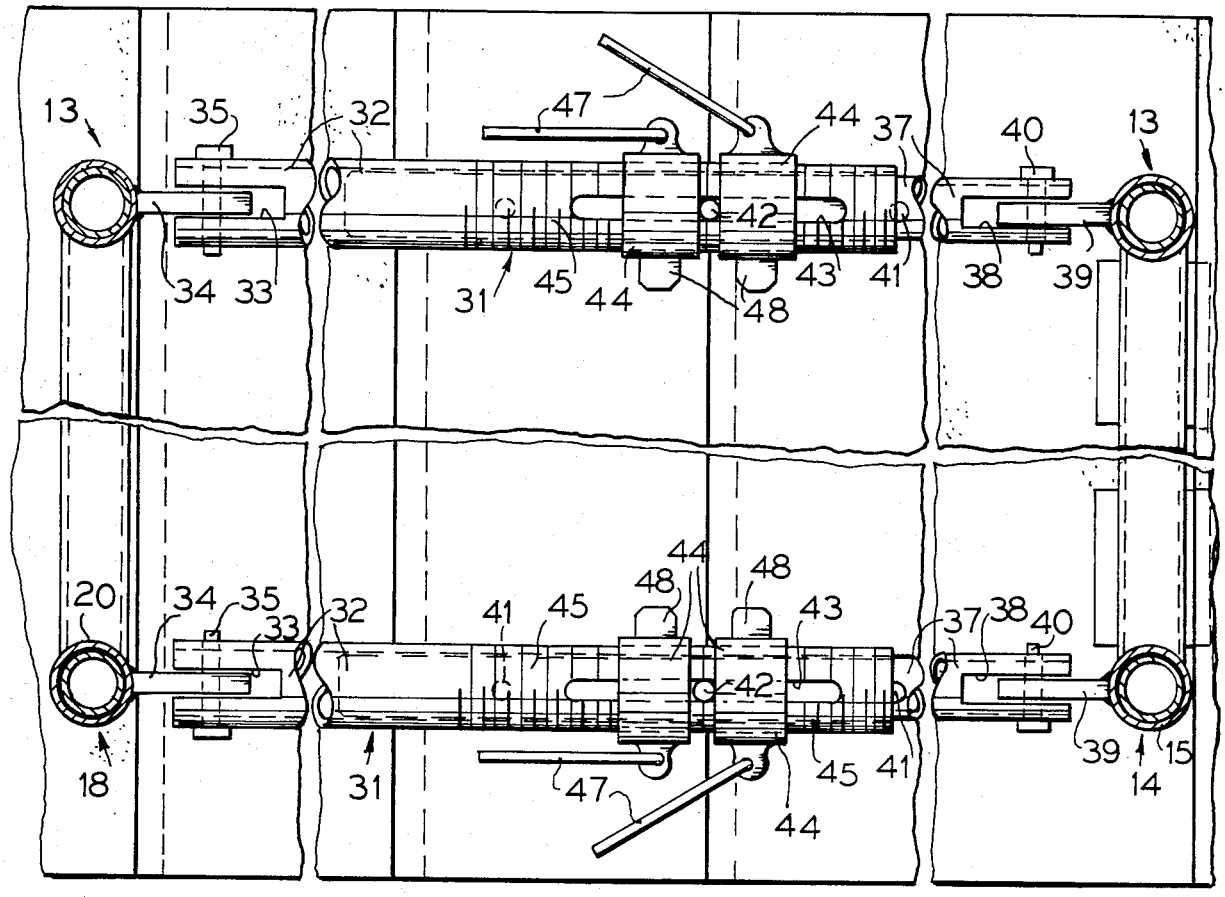
FIG. 4
FIG. 5
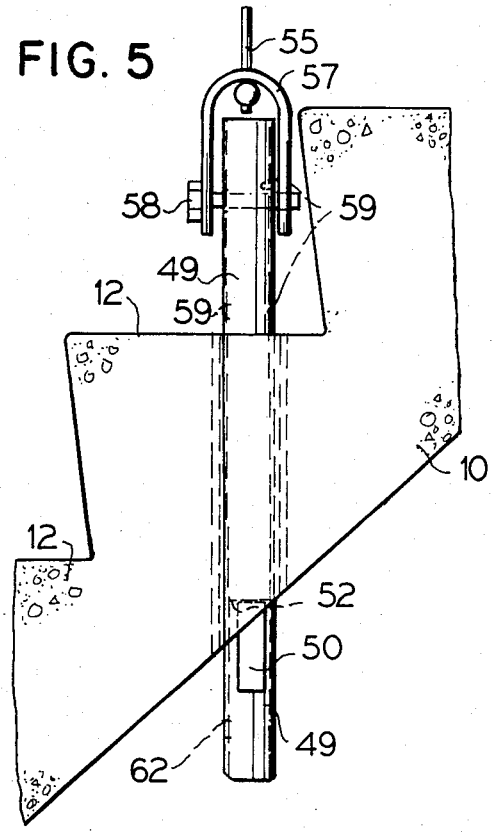
FIG. 6
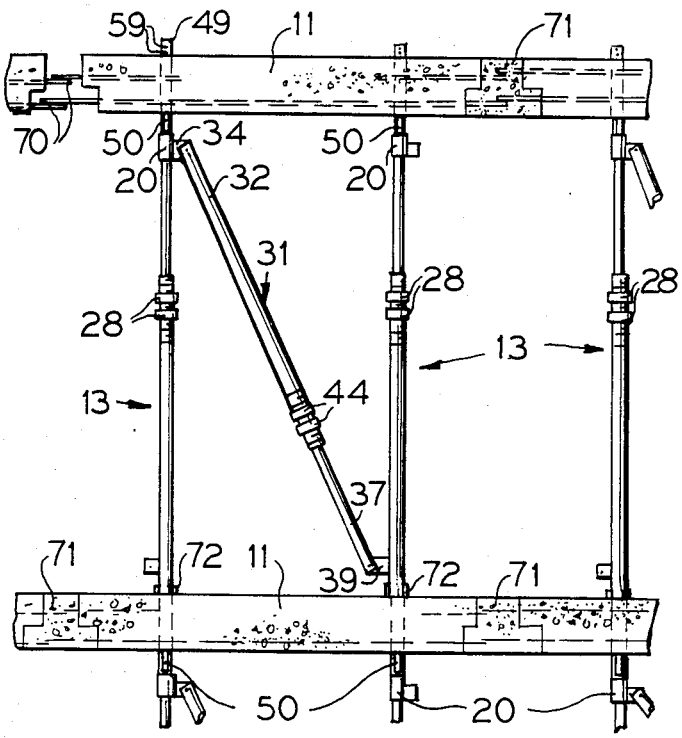

This invention relates to a method of and means for erecting precast upwardly facing slabs in building construction and is more particularly concerned with the use of novel shoring assembly means in the erecting of slabs.

The use of precast building slabs in building construction is gaining ever increasing popularity because of the manifest economic benefits, as well as often greater structural accuracy, as well as other benefits. However, a major problem in this type of construction is the lack of fully satisfactory means for handling and supporting the slabs and especially precast stairs. It is to the alleviation of this problem that the present invention is directed.

Pursuant to the present invention, there is provided a method of erecting preformed slabs in building construction, comprising raising a first upwardly facing preformed slab into erected orientation, supporting and maintaining said first slab in said orientation on a first prefabricated temporary generally rectangular walkthrough self-stable shoring frame assembly, attaching said first slab while supported on said first shoring frame assembly in permanent supported relation to associated building structures, mounting a second prefabricated temporarily generally rectangular walkthrough self-stable shoring frame assembly on top of said first slab, raising and erecting a second preformed slab in spaced generally parallel relation above said first slab on said second temporary walkthrough shoring frame assembly for permanent attachment to associated building structure, and removing said first shoring frame assembly for reuse.

There is also provided by the present invention a method of erecting preformed slabs in building construction, comprising providing in a temporary stable shoring frame assembly, a rigid generally U-shaped walkthrough base member having upstanding arms, and connecting lower ends of upright extension elements of upwardly projecting staff means to the upper ends of said arms; relatively vertically adjusting said extension elements and said arms to a predetermined height relationship; mounting said base member temporarily on a solid support; raising a preformed slab into temporary supported relation on top of said staff means and releasably connecting said slab thereto for stability; permanently attaching said raised slab, while thus supported, to associated building structure; and removing said shoring frame assembly for reuse.

This invention also provides for use in erecting preformed slabs in building construction, a stable temporary shoring frame assembly including a rigid generally U-shaped walkthrough base member having upstanding arms, and upwardly projecting staff means including upright extension elements with lower ends thereof connected to the upper ends of said arms; means for vertically adjusting said extension elements and said arms to a predetermined height relationship; said base member being adapted for temporary mounting of the frame assembly on a solid support; said staff means being adapted for receiving a preformed slab raised to and placed on top of said staff means for support by said shoring frame assembly in erected position; and means for releasably connecting said slab to said staff means for stability while the slab supported on the shoring frame assembly is permanently attached to associated building structure; said shoring frame assembly being removable for reuse after said slab has been permanently connected to said associated building structure.

Other objects, features and advantages of the invention will be readily apparent from the following description of representative embodiments thereof, taken in conjunction with the accompanying sheets of drawings, although variations and modifications may be effected without departing from the spirit and scope of the novel concepts embodied in the disclosure and in which:

FIG. 4 is an enlarged fragmental sectional elevational view taken substantially along the line IV—IV of FIG. 1;

FIG. 5 is an enlarged fragmentary elevational detail view taken substantially in the plane of line V—V of FIG. 2; and FIG. 6 is fragmentary more or less schematic elevational view showing a modification.

Figure 1:
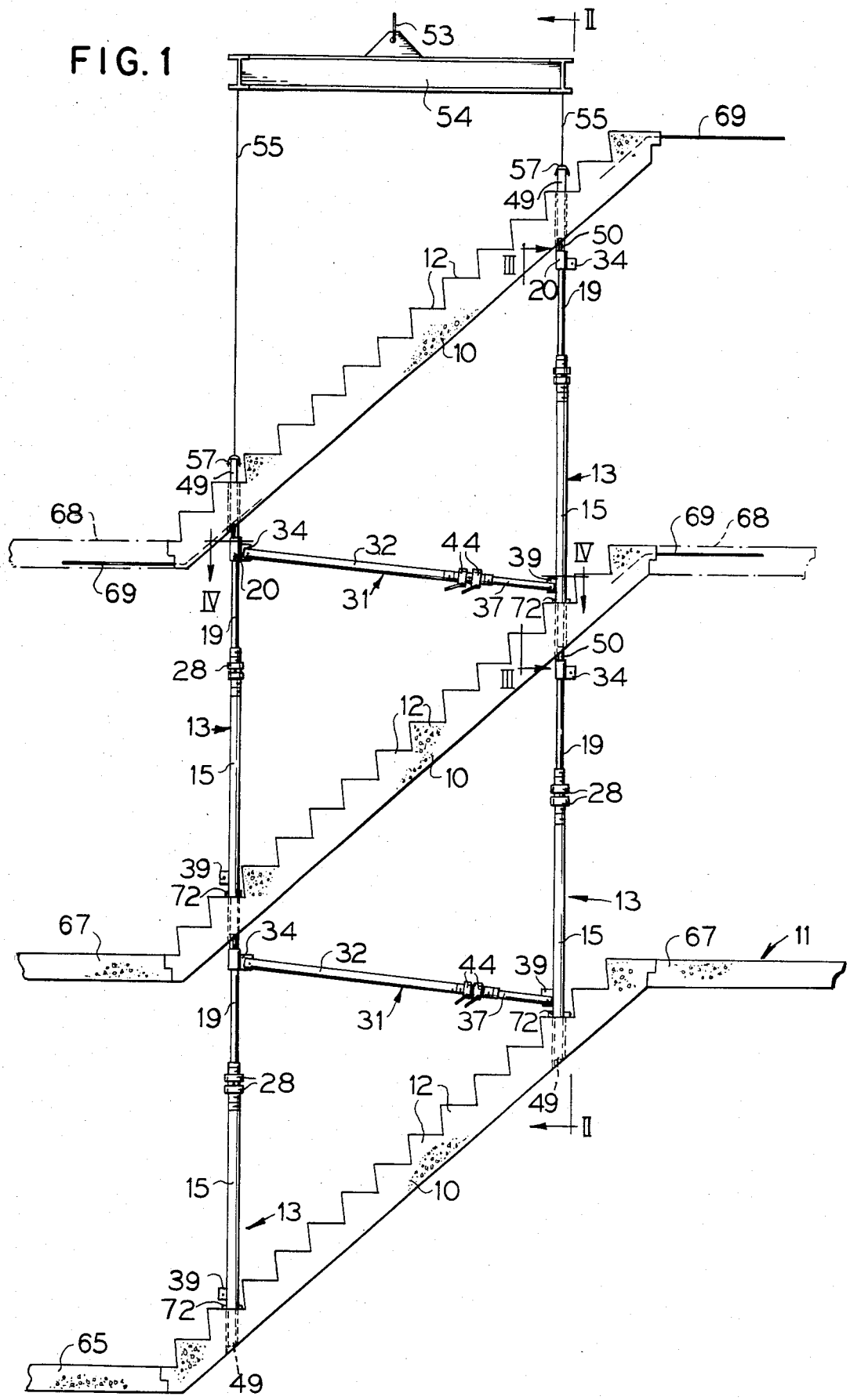
FIG. 1 is a more or less schematic illustration demonstrating the method and shoring apparatus pursuant to the present inven- tion.

Preformed stair slabs 10 (FIG. 1) and preformed deck slabs 11 (FIG. 6) may be generically referred to herein as "upwardly facing" slabs. As to the stair slabs 10, their transverse axis at any given point lies horizontally, as do tread surfaces 12, even though the longitudinal axis of the slab is diagonal in keeping with the stairway function of the slabs. The slabs 11, of course, lie in a horizontal plane. Both forms of the slabs face upwardly. For erecting either form of the preformed slabs, i.e. the stair slabs 10 or the deck slabs 11, generally rectangular walkthrough self-stable shoring frame assemblies 13 are employed.

In a desirable arrangement, each shoring frame assembly 13 comprises at least one unit having a rigid generally U-shaped walkthrough base member 14 comprising upstanding arms 15 disposed in spaced parallel relation and secured rigidly together by a rigid hollow crossbeam 17 secured between the lower end portions of the arms 15. Each of the arms 15 is desirably tubular metal, and the crossbeam 17 is also of metal and having its major transverse dimension vertical for maximum stability with its opposite ends conformed to the outside diameter of the respective post-like arms 15 and permanently fixedly secured thereto as by means of welding. In a typical construction, each of the arms 15 may be formed from about $2\frac{3}{8}$ inch outside diameter tubing about $5\frac{1}{2}$ feet long. The crossbeam 17 may be about 6 inches wide by 2 inches thick and on the order of 2 feet long. These dimensional relationships are especially suitable for a walkthrough shoring frame assembly especially adapted for erecting the stair slabs 10. For erecting deck slabs 11, some of the dimensional relationship just stated and others to be described may be varied to suit particular circumstances.

Figure 3:
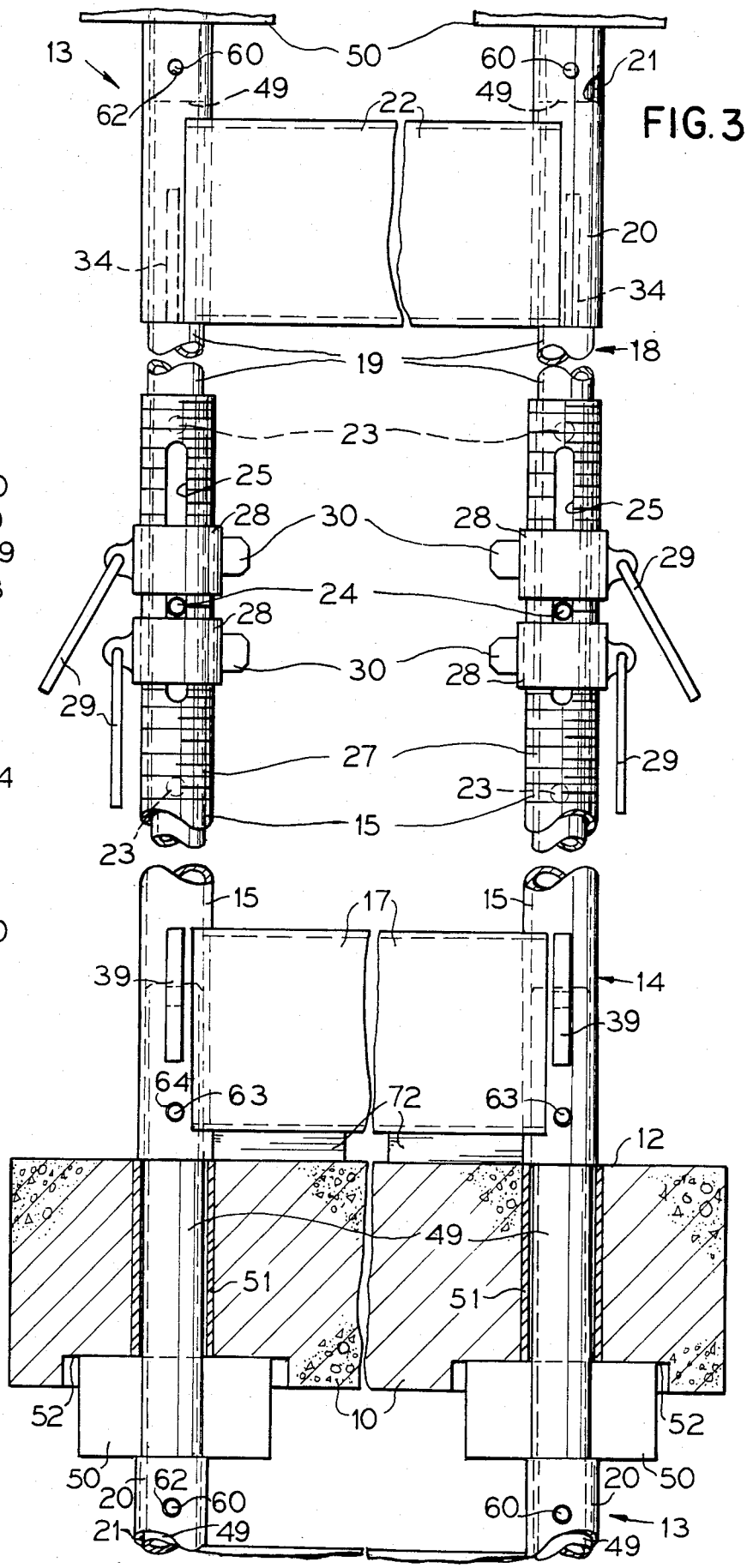
FIG. 3 is an enlarged fragmental sectional elevational view taken substantially along the line III—III of FIG. 1.

Upwardly projecting staff means 18 adapted for assembly with the base member 14 comprises a pair of upright extension legs 19 which may be formed from rigid tubular metal with the outside diameter of the leg telescopically slideably engageable within the upper ends of the arms 15 as best seen in FIG. 3. On the upper course, the cable elements 55 may be of equal length where the slab is to be mounted in a perfectly flat horizontal position.

An advantage in the extension of the lower end portions of the fingers 49 below the associated slabs is that the downwardly projecting portions of the fingers 49 on a lifted slab can be used for keying the slab as lowered into position in the proper orientation for attachment in permanent position in the building structure. For this purpose the shoring assemblies 13 are set up on a solid base, such as a previously fully erected and fixed stair slab 10, as shown in FIG. 1, or on a previously completed deck such as may be constructed of slabs 11 which have been earlier erected. Thus, by having the shoring assemblies 13 properly adjusted, upon receiving the lower locating or keying end portions of the fingers 49 in the sockets 21 (FIGS. 1, 2 and 3), exact orientation of the slab in its desired erected position is attained, and the slabs are supported on the upper ends of the head sleeves 20 by resting on the lower edges of the lugs 50. For maximum stability, it is desirable to releasably lock the pins in the sockets 21 as by means of respective pins or bolts 60 extending through aligned bolt holes 59 and 62 in the respective fingers 49 and head sleeves 20 (FIGS. 3 and 5). Stability is further enhanced by supporting the lower ends of the fingers 49 upon the upper head ends of the leg extensions 19 within the sockets 21, as best seen at the top of FIG. 3.

Figure 2:
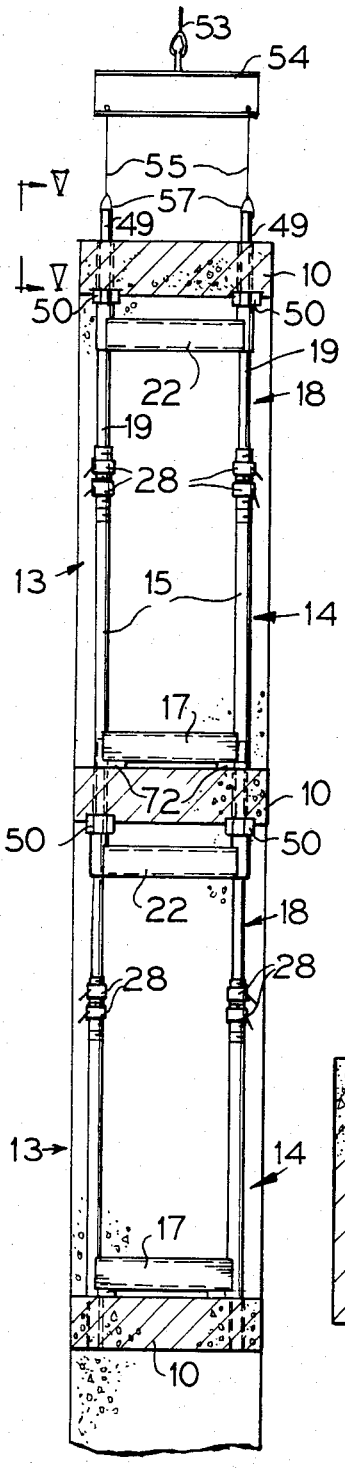
FIG. 2 is a vertical sectional detail view taken substantially along the line II—II of FIG. 1.

After the respective slab has been placed in position on the shoring frame assembly, the lifting cables 53 are separated by pulling the connecting bolts 58. Then, a succeeding shoring assembly can be mounted on the newly erected slab while still supported on the underlying shoring assembly. Accuracy in placement of the superimposed shoring assembly is facilitated by engagement of the upper end portions of the fingers 49 within the hollow downwardly opening lower ends of the shoring assembly arms 15, as best seen in FIGS. 2 and 3. The lower ends of the arms 15 will rest upon the subjacent slab. For maximum stability, the lower end portions of the arms 15 are desirably releasably secured to the fingers 49 as by means of cross pins or bolts 63 extending through a selected one of the bolt holes 59 in the upper or head portion of the associated pin and a corresponding bolt hole 64 through the lower end portion of the arm 15 in each instance. Such bolting is also a convenience in holding the pins 49 against dropping when the shoring assembly subjacent the now permanently fixed slab is removed, which is easily accomplished by pulling the bolts 60, running the lowermost of the ring nuts 28 down along the threaded section 27 of the associated leg 15 and thereby dropping the head sleeve ends of the extension legs 19 below the lower ends of the fingers 49. The then removed shoring frame assembly is adapted for reuse.

By means of the shoring frame assembly structures described, a succession of stair slabs 10 can be installed in a stairwell progressively as raising of a building progresses floor by floor. Thus, as demonstrated in FIG. 1, the lowermost stair slab 10 has been fully integrated and permanently secured at its lower end with respect to a deck 65, and at its upper end with respect to a deck 67. The temporary, generally rectangular walkthrough, self-stable shoring frame assembly 13 installed on the lowermost stair slab 10 supports the next higher stair slab 10 in parallel relation to the lower slab 10 and in proper orientation for permanent securement of the lower end of the upper stair slab to the supporting deck 67 while the upper end of the upper stair slab is supported in position to be permanently secured to a deck 68 under construction. Inasmuch as the second floor slab 10 is firmly supported in position by the subjacent shoring assembly 13, another shoring assembly 13 is adapted to be mounted on top of the supported stair slab 10 for supporting erected position in a next succeeding stair slab 10 so that the lower end of this slab can be integrated into and permanently secured to the deck 68. It may be noted that especially where the several decks are molded in situ, the respective ends of the floor slabs may be equipped with tie-in reinforcing rod extensions 69. Thus, as many stair slabs 10 as desired may be progressively erected. After each stair slab 10 has become fully supported by the associated building structure, the subjacent shoring frame assembly can be dismantled and reused. It may also be noted that an important attribute of the shoring assembly means of the present invention resides in that as each of the stair slabs 10 is erected, it can immediately be used, as is evident from FIG. 2, where it will be apparent that each of the shoring assemblies 13 affords ample walkthrough opening or tunnel-like clearance or passageway therethrough between the generally U-shaped assembled components or members 14 and 18, under the supported slab. This is especially advantageous for permitting virtually unobstructed access by tradesmen who can thereby freely use the stair slabs as stairs even though the shoring assemblies may still be in place above or below any stair slab in the associated building structure. This eliminates need for ladders where the stair slabs are in their erected positions by aid of the shoring assemblies 13.

When erecting the deck slabs 11, much the same procedure may be employed as in erecting the stair slabs 10, that is as each deck of the slabs 11 is completed and the deck becomes self-supporting, the subjacent shoring assemblies are dismantled, and are adapted to be used for erecting succeeding slab decks. Certain or all of the edges of each of the deck slabs 11 may be provided with exposed reinforcing rods 70 which are adapted to cooperate with the corresponding projecting rods of aligned slabs in the deck, or walls if desired, and then permanently secured in a grout joint 71.

For improved base support and stability, the shoring assemblies 13 are desirably equipped with foot plates 72 secured to the lower edges of the base crossbeams 17, coplanar with the lower ends of the arms 15. Thereby the area of support of the shoring frame assembly 13 in each instance on the supporting slab is substantially increased.

It will be understood that variations and modifications may be effected without departing from the spirit and scope of the novel concepts of this invention.

I claim as my invention:

1. For use in erecting preformed slabs in building construction:

a stable prefabricated temporary shoring frame assembly including a rigid generally U-shaped walkthrough base member having upstanding arms connected together at their lower ends by a transverse bar, and upwardly projecting staff means including upright extension elements with lower ends thereof connected adjustably to the upper ends of said arms;

said arms and the connected staff means providing a substantially unobstructed passageway for workmen to walk therethrough;

means for vertically adjusting said extension elements and said arms to a predetermined height relationship;

said base member adapted for temporary mounting of the lower ends of the frame assembly on a solid support;

said staff means being adapted for receiving a preformed slab raised to and placed on top of said staff means for support by said shoring frame assembly in erected position;

and means for releasably connecting said slab to said staff means for stability while the slab supported on the shoring frame assembly is being permanently attached to associated building structure;

said passageway permitting workmen to walk freely therethrough while said slab is supported on said frame assembly;

said shoring frame assembly being removable for reuse after said slab has been permanently connected to said associated building structure;

said connecting means comprising combination lifting and locating pins of greater length than the thickness of said slab, upper ends of said pins being adapted for connection to hoisting apparatus for raising the slab and for locating pin cooperation with downwardly opening sockets in the lower ends of the arms of a similar shoring frame assembly superimposed on said slab, and lower portions of said pins having lifting lug means engageable under the slab for hoisting support of the slab, and said lower portions of the pins extending below said lifting lug means and being adapted for locating cooperation within upwardly opening sockets in the upper ends of the extension elements of said slab supporting shoring frame assembly.

2. A shoring frame assembly according to claim 1, wherein said lower ends of said extension elements are received telescopically within said upper ends of said arms, and said adjusting means functioning for locking said elements and arms in selected telescopically adjusted relation.

3. A shoring frame assembly according to claim 1, wherein said base member comprises a base crossbeam rigidly secured at its ends to lower portions of said arms and being the sole securing means extending between said arms, and said upright extension elements have a head end crossbeam rigidly connected at its opposite ends to said elements adjacent to the upper ends of the elements so that said staff means comprises an inverted U-shaped member, said head end crossbeams being the sole securing means extending between said elements.

4. A shoring frame assembly according to claim 1, wherein said base member has foot plate means for stable engagement with said solid support.

5. A shoring frame assembly according to claim 1, wherein said means for vertically adjusting said extension elements and said arm comprises one of each of said arms and upright extension elements being vertically adjustably telescopically engaged within the other so that in each instance there is an inner member and an outer member, said inner member having a plurality of spaced pin receiving holes therethrough, said outer member having diametrically opposite pin clearing slots, a pin extending through said slots and through a selected one of the pin receiving holes, said outer member being externally threaded along said slots, and a ring nut threaded onto said outer member below said pin, said pin resting in load bearing relation on said ring nut and by vertical adjustment of said ring nut on said outer member vertical adjustment of said extension element in each instance being adapted to be effective relative to the associated arm.

6. A shoring frame assembly according to claim 1, wherein said extension elements have attachment ears adjacent their upper ends and said arms have attachment ears adjacent their lower ends, said attachment ears being adapted for attachment thereto of diagonal brace means between said shoring frame assembly and a like companion shoring frame assembly.

7. For use in erecting preformed slabs in building construction:

a stable prefabricated temporary shoring frame assembly comprising a pair of units each including a rigid generally U-shaped walkthrough base member having upstanding arms connected together at their lower ends by a transverse bar, and upwardly projecting staff means including upright extension elements with lower ends thereof connected adjustably to the upper ends of said arms;

said arms and the connected staff means providing a substantially unobstructed passageway for workmen to walk therethrough;

means for vertically adjusting said extension elements and said arms to a predetermined height relationship;

said base member being adapted for temporary mounting of the lower ends of the frame assembly on a solid support;

said staff means being adapted for receiving a preformed slab raised to and placed on top of said staff means for support by said shoring frame assembly in erected position;

means for releasably connecting said slab to said staff means for stability while the slab supported on the shoting frame assembly is being permanently attached to associated building structure;

said passageway permitting workmen to walk freely therethrough while said slab is supported on said frame assembly;

said shoring frame assembly being removable for reuse after said slab has been permanently connected to said associated building structure; and diagonal brace means connecting the base member of one of said units with the staff means of the other of said units alongside said walkthrough passageway.

8. A shoring frame assembly according to claim 7, wherein said arms and said extension elements have respective attachment ear lugs for connection thereto of said diagonal brace means.

9. A shoring frame assembly according to claim 7, including means for longitudinally adjusting said brace means.

10. A shoring frame assembly according to claim 7, wherein said brace means comprise struts having telescopically related members, and means for longitudinally adjusting and locking said longitudinally adjustable members.

11. A shoring frame assembly according to claim 7, wherein said means for vertically adjusting said extension elements and said arm comprises one of said each of said arms and upright extension elements being vertically adjustably telescopically engaged within the other so that in each instance there is an inner member and an outer member, said inner member having a plurality of spaced pin receiving holes therethrough, said outer member having diametrically opposite pin clearing slots, a pin extending through said slots and through a selected one of the pin receiving holes, said outer member being externally threaded along said slots, a ring nut threaded onto said outer member below said pin, said pin resting in load bearing relation on said ring nut and by vertical adjustment of said ring nut on said outer member vertical adjustment of said extension element in each instance being adapted to be effective relative to the associated arm, said upper ring nut being adapted for releasably locking said pin between said ring nuts.

12. A shoring frame assembly according to claim 10, wherein the adjustable member which is the innermost of the telescopically engaged members has at spaced intervals pin holes, the outer of said adjustable members having diametrically opposite aligned longitudinal slots, an adjustment pin received through a selected one of said pin holes, the outer of said adjustable members having a threaded section along said slots, ring nuts threadedly engaged upon the threaded section at respectively opposite sides of said pin, and means for operating said ring nuts for adjusting said pin along said slots for longitudinally adjusting said adjustable members, and for tightening the nuts against said pin for thereby locking said adjustable member in adjusted relation.

13. A shoring frame assembly according to claim 7, wherein said extension elements and arms comprise telescopically engaged members and said brace means comprise telescopically engaged members, and means for telescopically adjusting the extension elements and arms and telescopically adjusting the brace members for obtaining optimum positioning of the slab supported on the shoring frame assembly.

14. A shoring frame assembly according to claim 7, wherein said connecting means comprise combination lifting and locating pins of greater length than the thickness of said slab, upper ends of said pins being adapted for connection to hoisting apparatus for raising the slab and for locating pin cooperation with downwardly opening sockets in the lower ends of the arms of a similar shoring frame assembly superimposed on said slab, lower portions of said pins having lifting lug means engageable under the slab for hoisting support of the slab, and said lower portions of the pins extending below said lifting lug means and being adapted for locating cooperation within upwardly opening sockets in the upper ends of the extension elements of said slab supporting shoring frame.

15. For use in erecting preformed slabs in building construction:

a stable prefabricated temporary shoring frame assembly comprising a pair of units each including a rigid generally U-shaped walkthrough base member having upstanding arms connected together at their lower ends by a transverse bar, and upwardly projecting staff means including upright extension elements with lower ends thereof connected adjustably to the upper ends of said arms;

said arms and the connected staff means providing a substantially unobstructed passageway for workmen to walk therethrough;

means for vertically adjusting said extension elements and said arms to a predetermined height relationship;

said base member being adapted for temporary mounting of the lower ends of the frame assembly on a solid support;

said staff means being adapted for receiving a preformed slab raised to and placed on top of said staff means for support by said shoring frame assembly in erected position;

means for releasably connecting said slab to said staff means for stability while the slab supported on the shoring frame assembly is being permanently attached to associated building structure;

said passageway permitting workmen to walk freely therethrough while said slab is supported on said frame assembly;

said shoring frame assembly being removable for reuse after said slab has been permanently connected to said associated building structure;

diagonal brace means connecting the base member of one of said units with the staff means of the other of said units alongside said walkthrough passageway;

said arms and said extension elements having respective attachment ear lugs for connection thereto of said diagonal brace means;

said brace means comprising struts having telescopically related members; and means for longitudinally adjusting and locking said longitudinally adjustable strut members.

16. A shoring frame assembly according to claim 15, wherein said means for vertically adjusting said extension elements and said arm comprises one of said each of said arms and upright extension elements being vertically adjustably telescopically engaged within the other so that in each instance there is an inner member and an outer member, said inner member having a plurality of spaced pin receiving holes therethrough, said outer member having diametrically opposite pin clearing slots, a pin extending through said slots and through a selected one of the pin receiving holes, said outer member being externally threaded along said slots, a ring nut threaded onto said outer member below said pin, said pin resting in load bearing relation on said ring nut and by vertical adjustment of said ring nut on said outer member vertical adjustment of said extension element in each instance being adapted to be effective relative to the associated arm.

17. A shoring frame assembly according to claim 15, wherein the adjustable member which is the innermost of the telescopically engaged strut members has at spaced intervals pin holes, the outer of said adjustable strut members having diametrically opposite alinged longitudinal slots, an adjustment pin received through a selected one of said pin holes, the outer of said adjustable strut members having a threaded section along said slot, ring nuts threadedly engaged upon the threaded section at respectively opposite sides of said pin, and means for operating said ring nuts for effecting adjustments of said pin along the slot and thus adjusting said strut members, and the nuts against said pin for thereby locking said adjustable strut members in adjusted relation.

18. A shoring frame assembly according to claim 15, wherein said extension elements and arms comprise telescopically engaged members and said brace means comprise telescopically engaged members, and means for telescopically adjusting the extension elements and arms and telescopically adjusting the brace members for obtaining optimum positioning of the slab supported on the shoring frame assembly.

* * * * *

United States Patent [19]

Baus

[11] Patent Number: 4,527,364

[45] Date of Patent: Jul. 9, 1985

[54] CORNER ASSEMBLY OF STRUCTURAL MEMBERS

[76] Inventor: Heinz G. Baus, 35 Wartbodenstrasse, CH-3626 Hünibach-Thun, Switzerland

[21] Appl. No.: 613,072

[22] Filed: May 22, 1984

[30] Foreign Application Priority Data

May 30, 1983 [DE] Fed. Rep. of Germany ..... 3319627

[51] Int. Cl.[3] ..... E04B 1/00; F16B 12/36

[52] U.S. Cl. ..... 52/127.7; 52/127.12; 52/284; 52/656; 403/231; 403/295

[58] Field of Search ..... 52/127.7, 127.12, 656, 52/657, 284; 403/295, 231, 7

[56] References Cited

U.S. PATENT DOCUMENTS

| | | | |
|---|---|---|---|
| 2,764,314 | 9/1956 | Mautner | 403/295 X |
| 3,574,378 | 4/1971 | Heywood | 403/231 |

FOREIGN PATENT DOCUMENTS

| | | | |
|---|---|---|---|
| 307656 | 9/1972 | Austria . | |
| 1225833 | 9/1966 | Fed. Rep. of Germany | 403/231 |
| 2129858 | 12/1972 | Fed. Rep. of Germany | 403/295 |
| 7437173.6 | 2/1975 | Fed. Rep. of Germany . | |
| 7711771.6 | 9/1977 | Fed. Rep. of Germany . | |
| 2738321 | 3/1978 | Fed. Rep. of Germany | 403/295 |
| 1218379 | 5/1960 | France | 52/656 |
| 58800 | 11/1967 | German Democratic Rep. . | |
| 350091 | 11/1960 | Switzerland . | |

*Primary Examiner*—Alfred C. Perham
*Assistant Examiner*—Jean M. LaKemper
*Attorney, Agent, or Firm*—Schwartz, Jeffery, Schwaab, Mack, Blumenthal & Evans

[57] ABSTRACT

Corner assembly of a first and a second structural member disposed at an angle. Each member has an inner open ended chamber formed by spaced inner and outer webs of the members. A corner connector member has a first and a second leg snugly fitting into one of the chambers. The inner web of the first structural member has a pair of openings and the first leg has likewise a pair of openings which are in registry with the first openings transversely of the first leg. A pair of securing projections, solid with the inner web of the second structural member is formed with a pair of third openings. The securing projections extend through the first and second openings. The first leg has a fourth opening which extends lengthwise and in registry with the third opening. Locking bolts pass successively through the third openings and through the fourth openings, the latter being tapped so that the locking bolt threads therewith to secure the structural members and the connector member together to form the corner assembly.

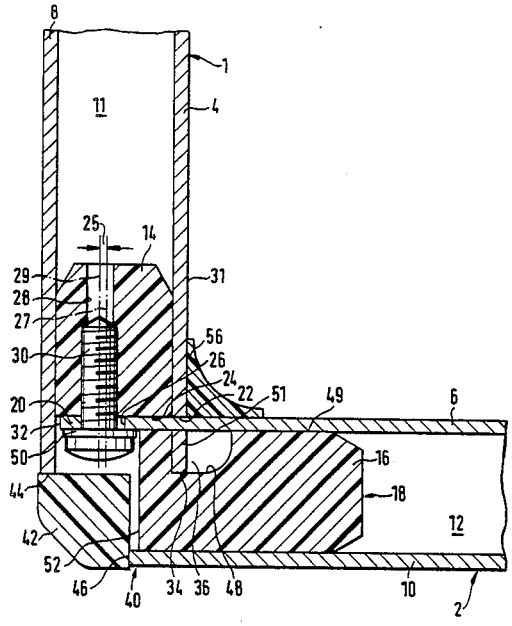

12 Claims, 3 Drawing Figures